US012480221B2

(12) United States Patent
Tsuji

(10) Patent No.: US 12,480,221 B2
(45) Date of Patent: Nov. 25, 2025

(54) PRE-WET PROCESS METHOD

(71) Applicant: EBARA CORPORATION, Tokyo (JP)

(72) Inventor: Kazuhito Tsuji, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 18/016,301

(22) PCT Filed: Oct. 14, 2021

(86) PCT No.: PCT/JP2021/038049
§ 371 (c)(1),
(2) Date: Jan. 13, 2023

(87) PCT Pub. No.: WO2023/062778
PCT Pub. Date: Apr. 20, 2023

(65) Prior Publication Data

US 2024/0247393 A1 Jul. 25, 2024

(51) Int. Cl.
*C25D 13/20* (2006.01)
*C25D 21/12* (2006.01)

(52) U.S. Cl.
CPC ..... *C25D 13/20* (2013.01); *C25D 21/12* (2013.01)

(58) Field of Classification Search
None
See application file for complete search history.

(56) References Cited

U.S. PATENT DOCUMENTS

2010/0320081 A1* 12/2010 Mayer ..... C25D 7/123 134/198
2018/0282892 A1* 10/2018 Fujikata ..... C25D 7/12

FOREIGN PATENT DOCUMENTS

JP 2001-316869 A 11/2001
WO WO 2010/148147 A2 12/2010
WO WO 2020/028012 A1 2/2020

OTHER PUBLICATIONS

Pozo "The Theory of Constraints: a Case Study as a Strategic Tooling in Production Management of a Small Sized Company" (Year: 2011).*

* cited by examiner

*Primary Examiner* — Wojciech Haske
(74) *Attorney, Agent, or Firm* — BakerHostetler

(57) ABSTRACT

Provided is a pre-wet process method by which a pre-wet process can be effectively performed on a substrate without affecting throughput. The pre-wet process method for performing the pre-wet process before performing a plating process on a substrate in a plating apparatus is provided. The pre-wet process method includes a step of calculating a maximum process time in a pre-wet module based on a rate limiting step of limiting a rate of a process in the whole plating apparatus, a step of calculating a minimum moving speed of the nozzle head in the pre-wet module based on the calculated maximum process time, and a step of moving the nozzle head at a speed equal to or more than the calculated minimum moving speed to supply a pre-wet liquid to the plate surface of the substrate.

10 Claims, 7 Drawing Sheets

400

PRE-WET PROCESS METHOD

CROSS-REFERENCE TO RELATED APPLICATIONS

This application is a U.S. national phase application of International Patent Application No. PCT/JP2021/038049 filed Oct. 14, 2021, which is incorporated by reference in its entirety for any and all purposes.

TECHNICAL FIELD

The present application relates to a pre-wet process method, and particularly to a method of performing a pre-wet process before performing a plating process on a substrate in a plating apparatus.

BACKGROUND ART

As an example of a plating module for performing a plating process on a substrate, a cup type electrolytically plating module is known. The cup type electrolytically plating module includes a substrate holder that holds the substrate (for example, a semiconductor wafer) with a surface to be plated being oriented downward. The substrate holder includes an electrical contact for applying a voltage to the substrate, and a sealing member that seals an edge portion of the substrate so that a plating solution does not act on this electrical contact. In the cup type electrolytically plating module, the substrate with the surface to be plated being oriented downward is immersed into the plating solution, and the voltage is applied between the substrate and an anode, thereby precipitating a conductive film on the surface of the substrate. A plating apparatus for processing a plurality of substrates may include a plurality of such cup type electrolytically plating modules.

CITATION LIST

Patent Literature

PTL 1: Japanese Patent Laid-Open No. 2001-316869

SUMMARY OF INVENTION

Technical Problem

In a plating apparatus, a pre-wet process may be performed on a substrate before a plating process in a plating module. The pre-wet process includes wetting a surface to be plated of the substrate before the plating process with a process liquid, such as pure water or deaerated water, to replace air inside a pattern formed on the surface of the substrate with the process liquid. This facilitates supplying a plating solution to the inside of the pattern by replacing the process liquid inside the pattern with the plating solution during plating.

In the pre-wet process, a time for and the number of times of wetting the surface to be plated of the substrate with the process liquid are increased, so that accuracy in replacing air inside the pattern on the surface of the substrate with the process liquid can be improved, and effects of the pre-wet process can be improved. On the other hand, in recent years, there has been a demand to improve throughput of the plating apparatus. Therefore, it is not preferable that lengthening of the time required for the pre-wet process reduces a process speed of the plating apparatus as a whole and reduces the throughput of the plating apparatus.

In view of the above-described actual situations, it is one object of the present application to provide a method by which a pre-wet process can be effectively performed on a substrate without affecting throughput.

Solution to Problem

According to one embodiment, a pre-wet process method for performing a pre-wet process before performing a plating process on a substrate in a plating apparatus is provided. The plating apparatus includes a plating module for performing the plating process on the substrate, and a pre-wet module for performing the pre-wet process on the substrate, and the pre-wet module includes a nozzle head configured to be able to supply a pre-wet liquid to a plate surface of the substrate with movement along the plate surface of the substrate. The pre-wet process method includes a step of calculating a maximum process time in the pre-wet module based on a rate limiting step of limiting a rate of a process in the whole plating apparatus, a step of calculating a minimum moving speed of the nozzle head based on the calculated maximum process time, and a step of moving the nozzle head at a speed equal to or more than the calculated minimum moving speed to supply the pre-wet liquid to the plate surface of the substrate.

DESCRIPTION OF EMBODIMENTS

Figure 1:
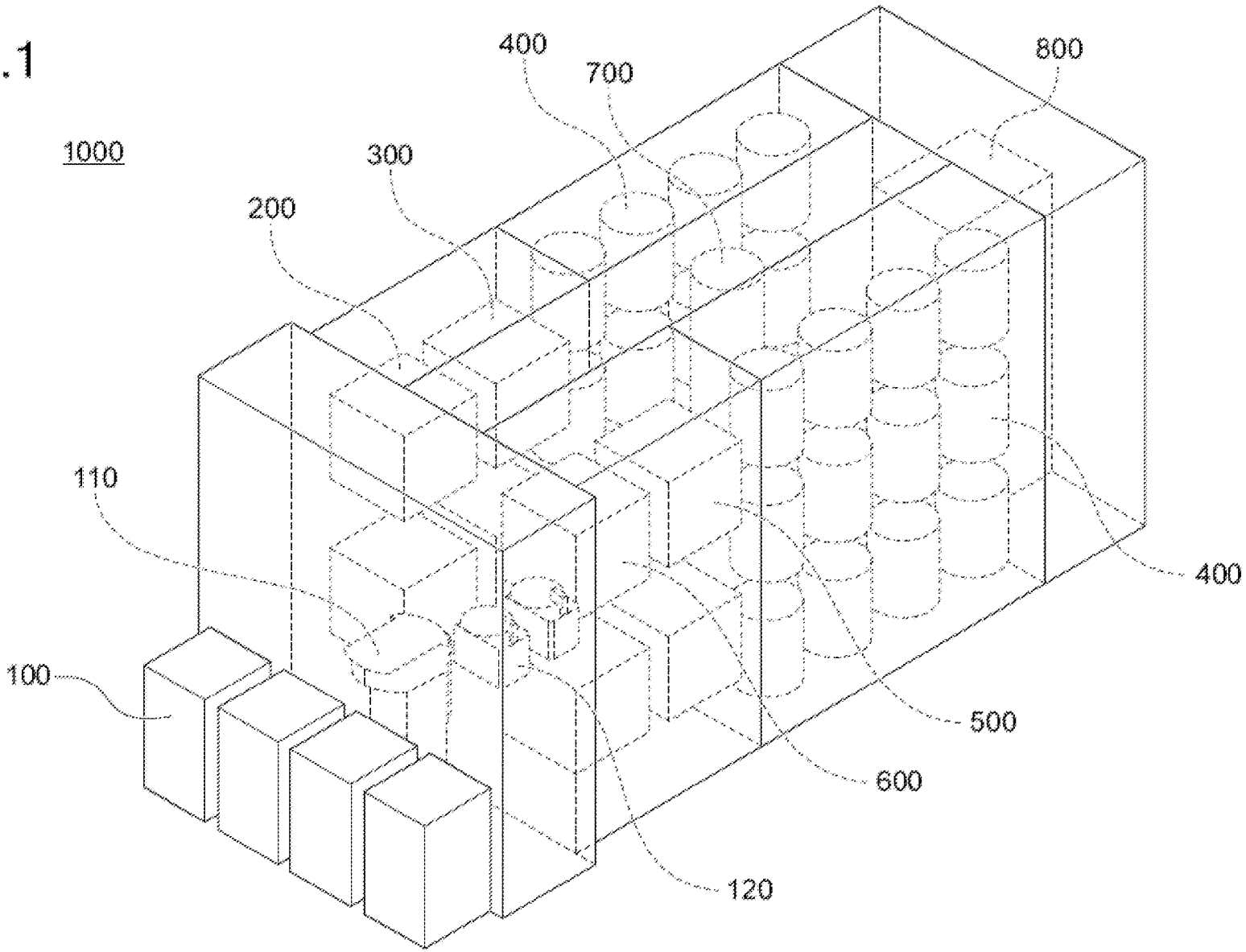
FIG. 1 is a perspective view illustrating the overall configuration of a plating apparatus of this embodiment.

Hereinafter, embodiments of the present invention will be described with reference to the drawings. In the drawings described below, the same or corresponding components are denoted with the same reference sign and will not be described in duplicate.

<Overall Configuration of Plating Apparatus>

Figure 2:
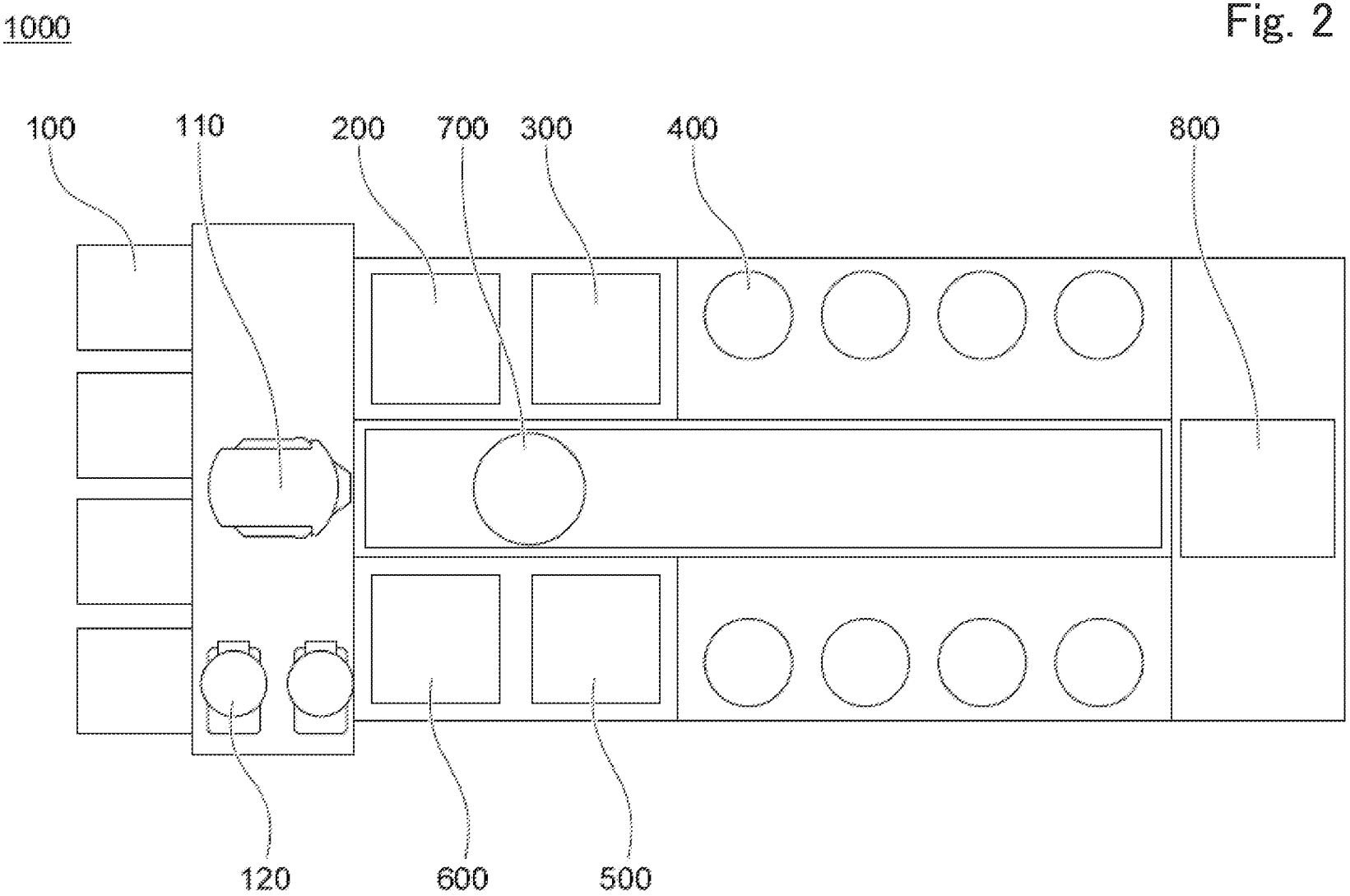
FIG. 2 is a plan view illustrating the overall configuration of the plating apparatus of the embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid (pre-wet liquid). The pre-wet module 200 is configured to perform a pre-wet process to facilitate supplying a plating solution to the inside of the pattern by replacing the process liquid inside the pattern with the plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

<Configuration of Plating Module>

Figure 3:
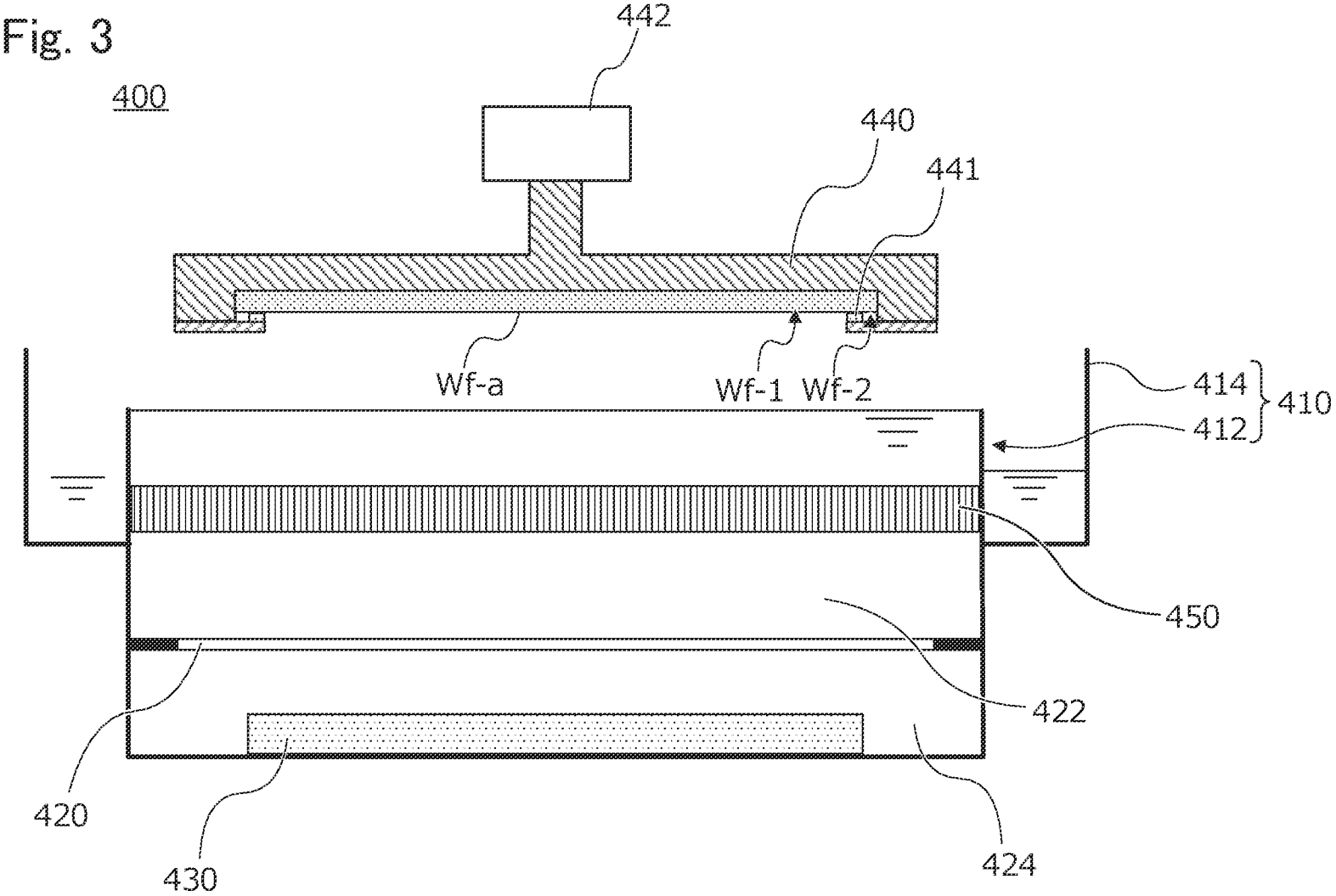
FIG. 3 is a longitudinal sectional view schematically illustrating a configuration of a plating module of the embodiment.

Next, a configuration of the plating module 400 will be described. Since 24 plating modules 400 in the present embodiment have the same configuration, one plating module 400 alone will be described. FIG. 3 is a longitudinal sectional view schematically illustrating the configuration of the plating module 400 of the present embodiment. As illustrated in FIG. 3, the plating module 400 includes a plating tank 410 for storing the plating solution. The plating tank 410 includes a cylindrical inner tank 412 having an open upper surface, and an outer tank 414 provided around the inner tank 412 so that the plating solution overflowing an upper edge of the inner tank 412 is accumulated.

The plating module 400 includes a membrane 420 that separates an inside of the inner tank 412 in an up-down direction. The inside of the inner tank 412 is divided into a cathode region 422 and an anode region 424 by the membrane 420. The cathode region 422 and the anode region 424 are each filled with the plating solution. On a bottom surface of the inner tank 412 of the anode region 424, an anode 430 is provided. In the cathode region 422, a resistor 450 opposing the membrane 420 is disposed. The resistor 450 is a member for uniformly performing the plating process in a surface to be plated Wf-a of a substrate Wf. In the present embodiment, an example where the membrane 420 and the resistor 450 are provided has been described, but the present invention is not limited to this example.

The plating module 400 includes, as an example, a substrate holder 440 that holds the substrate Wf in a state where the surface to be plated Wf-a is oriented downward.

In a state where a part (part to be plated) Wf-1 in the surface to be plated Wf-a is exposed, the substrate holder 440 grasps an edge portion Wf-2 that is an outer region of the part. The substrate holder 440 includes a sealing body 441 that seals the edge portion Wf-2 so that the plating solution does not act on the edge portion Wf-2 of the substrate Wf. The substrate holder 440 includes a power supply contact point in contact with the edge portion Wf-2 of the substrate Wf to supply power from a power source (not illustrated) to the substrate Wf. The plating module 400 includes an elevating/lowering mechanism 442 that elevates and lowers the substrate holder 440. The elevating/lowering mechanism 442 can be achieved by a known mechanism such as a motor. The substrate Wf is immersed in the plating solution of the cathode region 422 by use of the elevating/lowering mechanism 442, thereby exposing the part to be plated Wf-1 of the substrate Wf to the plating solution. The plating module 400 is configured to perform the plating process on the surface to be plated Wf-a (part to be plated Wf-1) of the substrate Wf by applying a voltage between the anode 430 and the substrate Wf in the above state. The elevating/lowering mechanism 442 is preferably configured to be able to rotate the substrate Wf in the plating process.

It has been described above that in the plating module 400, the plating process is performed in the state where the surface to be plated Wf-a of the substrate Wf is oriented downward, but the present invention is not limited to this example. As an example, in the plating module 400, the plating process may be performed in a state where the surface to be plated Wf-a is oriented upward or laterally.

<Configuration of Pre-Wet Module>

Figure 4:
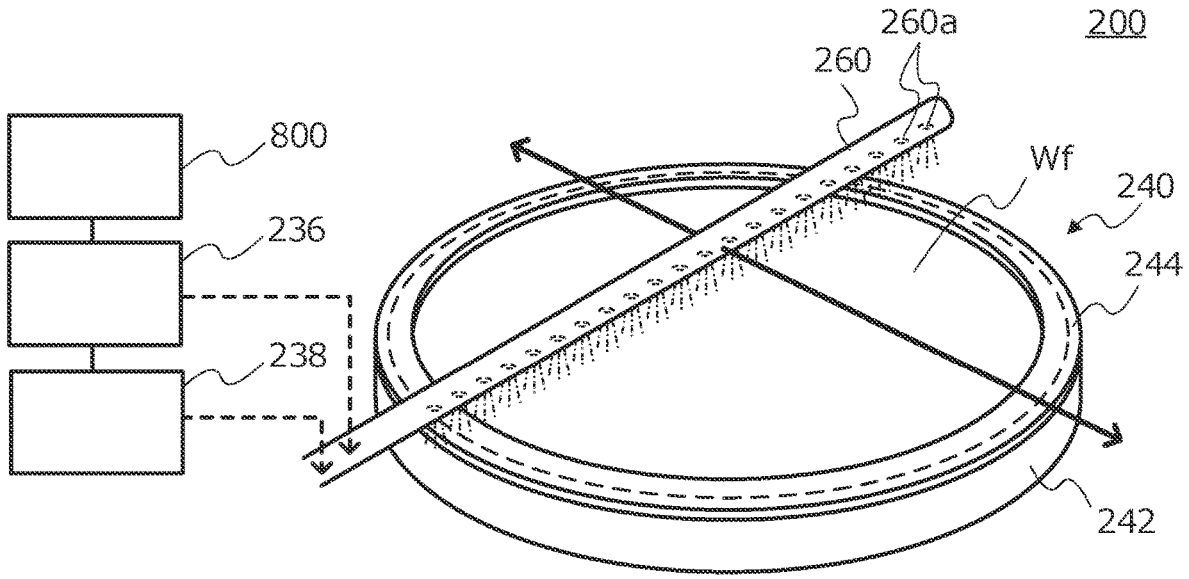
FIG. 4 is a perspective view schematically illustrating a configuration of a pre-wet module of the embodiment.
Figure 5:
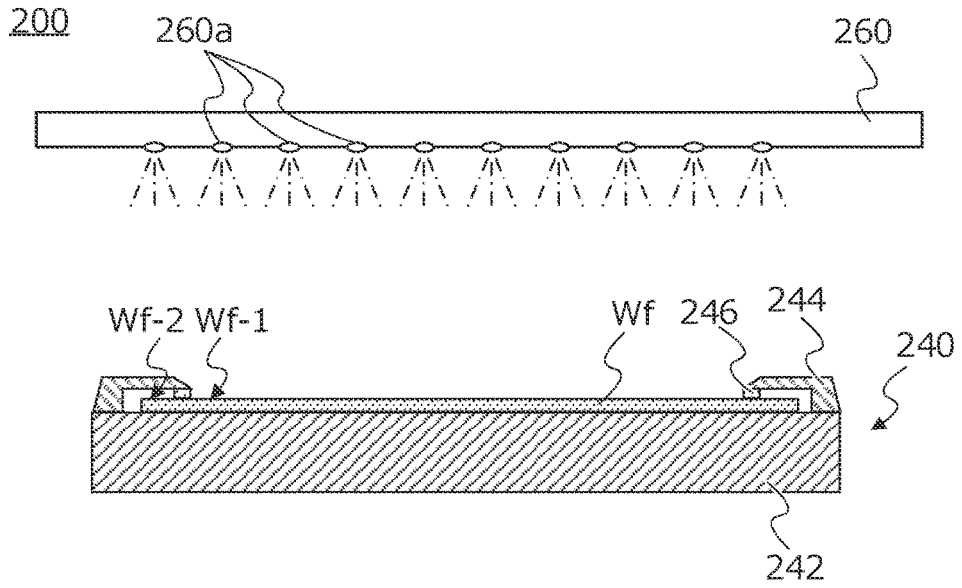
FIG. 5 is a view in which the pre-wet module in FIG. 4 is projected along a moving direction of a nozzle module.
Figure 6:
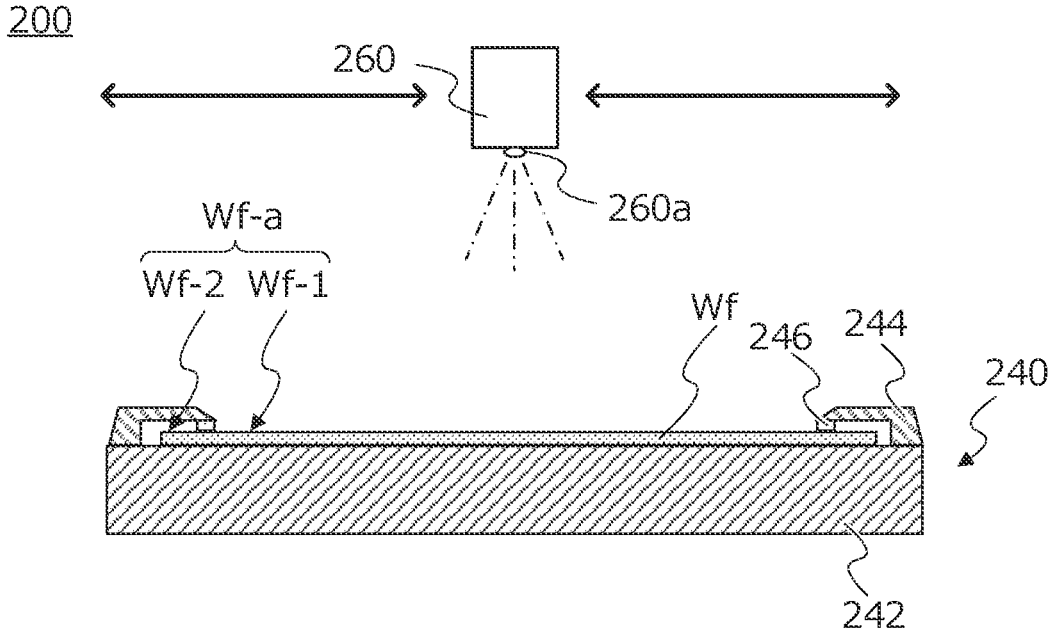
FIG. 6 is a view in which the pre-wet module in FIG. 4 is projected along a longitudinal direction of the nozzle module.

Next, a configuration of the pre-wet module 200 of the present embodiment will be described. Since two pre-wet modules 200 in the present embodiment have the same configuration, one pre-wet module 200 alone will be described. FIG. 4 is a perspective view schematically illustrating the configuration of the pre-wet module 200 of the present embodiment. FIG. 5 is a view in which the pre-wet module in FIG. 4 is projected along a moving direction (see bold arrows in FIG. 4) of a nozzle module, and FIG. 6 is a view in which the pre-wet module in FIG. 4 is projected along a longitudinal direction of the nozzle module. As illustrated in FIGS. 4 to 6, the pre-wet module 200 of the present embodiment includes a pre-wetting stage 240 for supporting the substrate Wf, and a nozzle head 260 for supplying a pre-wet liquid, such as pure water or deaerated water.

In the present embodiment, the pre-wetting stage 240 is configured to hold the substrate Wf in a state where the surface to be plated Wf-a is oriented upward. However, the present invention is not limited to this example, and the pre-wetting stage 240 may be configured to hold the substrate in a state where the surface to be plated Wf-a is oriented downward or in the horizontal direction. Further, the pre-wetting stage 240 may hold the substrate with the surface to be plated Wf being inclined with respect to the vertical direction or the horizontal direction. The pre-wet module 200 may further include a drive mechanism that drives the pre-wetting stage 240. As an example, the pre-wetting stage 240 may be configured to be movable in at least one of the horizontal direction and the vertical direction. The pre-wetting stage 240 may be configured to be able to rotate the substrate Wf in the pre-wet process. Further, the pre-wetting stage 240 may be configured to be able to change the orientation of the surface to be plated Wf-a or may be configured to invert the substrate Wf upside down.

In the present embodiment, the pre-wetting stage 240 includes a first holding member (supporter) 242 having a support surface for supporting a back surface of the surface to be plated Wf-a of the substrate Wf, and a second holding member 244 configured to be attachable to and detachable from the first holding member 242. As an example, the pre-wetting stage 240 is configured to hold the substrate Wf by sandwiching the substrate Wf between the first holding member 242 and a sealing body 246. However, the present invention is not limited to this example. For example, the pre-wetting stage 240 may be configured to hold the substrate Wf by a vacuum chuck provided on the first holding member 242.

The second holding member 244 has the sealing body 246 that comes in contact with the surface to be plated Wf-a of the substrate Wf for sealing the edge portion Wf-2 of the substrate Wf. The sealing body 246 prevents the pre-wet liquid from acting on the edge portion Wf-2 of the substrate Wf. However, the present invention is not limited to this example, and the pre-wetting stage 240 need not have the sealing body 246 for sealing the edge portion Wf-2 of the substrate Wf or need not have the second holding member 244.

The nozzle head 260 is provided to supply the pre-wet liquid to the plate surface (surface to be plated Wf-a) of the substrate Wf. In the present embodiment, as illustrated in FIGS. 4 and 6, the nozzle head 260 is configured to eject the pre-wet liquid to the substrate Wf while moving along the plate surface (surface to be plated Wf-a) of the substrate Wf, above the substrate Wf. The pre-wet liquid may be sprayed with rotation of the pre-wetting stage 240 (substrate Wf). In the present embodiment, the nozzle head 260 is configured in a long shape having a plurality of ejection ports 260*a* along the longitudinal direction. Then, the nozzle head 260 is configured to be movable along the surface to be plated Wf-a so that the pre-wet liquid is ejected from the plurality of ejection ports 260*a* while changing a spray position in the surface to be plated Wf-a (see bold arrows in FIGS. 4 and 6). In such an example as shown in FIGS. 4 and 5, the nozzle head 260 has the plurality of ejection ports 260*a* over a region longer than a diameter of the substrate Wf (or a diameter of the surface to be plated Wf-a) in the longitudinal direction and is configured to move in a direction perpendicular to the longitudinal direction of the nozzle head 260 that is a scanning direction. This configuration can supply the pre-wet liquid to an entire area of the surface to be plated Wf-a by moving once in the scanning direction. However, the nozzle head 260 is not limited to this example and may have a plurality of ejection ports 260*a* over a region shorter than the diameter of the substrate Wf or may have a single ejection port. In this case, the nozzle head 260 may be configured to be movable in two dimensions along the plate surface of the substrate Wf or may supply the pre-wet liquid with the rotation of the pre-wetting stage 240 (substrate Wf).

As illustrated in FIG. 4, a pre-wet liquid supply source 238 for supplying the pre-wet liquid to the nozzle head 260 is connected to the nozzle head 260. The pre-wet liquid supply source 238 is configured to supply a pre-wet liquid, such as pure water or deaerated water, to the nozzle head 260. The pre-wet liquid supply source 238 may be configured to supply a single type of pre-wet liquid to the nozzle head 260 or may be configured to selectively supply two or more types of pre-wet liquid to the nozzle head 260. The nozzle head 260 is connected to a drive mechanism 236. The drive mechanism 236 is configured to move the nozzle head 260 along the plate surface of the substrate Wf in response to a command from the control module 800. As an example, the drive mechanism 236 can be achieved by a known mechanism such as a motor. The drive mechanism 236 may be configured to be able to adjust a distance between each ejection port 260*a* of the nozzle head 260 and the substrate Wf.

Figure 7:
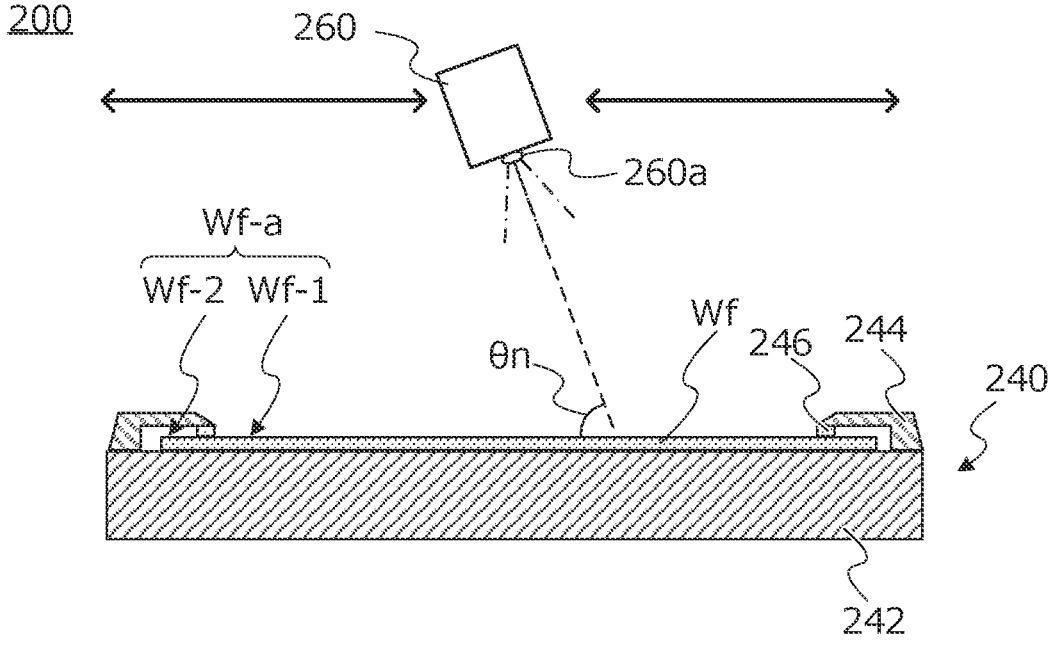
FIG. 7 is a view illustrating another form of the pre-wet module and corresponding to FIG. 6.

FIG. 7 is a view illustrating another form of the pre-wet module and corresponding to FIG. 6. In the example illustrated in FIGS. 4 to 6, the nozzle head 260 is configured with an injection center direction of the pre-wet liquid from the ejection ports 260*a* being perpendicular to the plate surface (surface to be plated Wf-a) of the substrate Wf. However, the nozzle head 260 is not limited to this example and may be configured so that, as illustrated in FIG. 7, the injection center direction of the pre-wet liquid is inclined with respect to the plate surface of the substrate Wf (at an angle θn in the example illustrated in FIG. 7). Further, the nozzle head 260 may be configured to be able to change an injection direction (injection center direction) of the pre-wet liquid by the drive mechanism 236.

<Pre-Wet Method>

Figure 8:
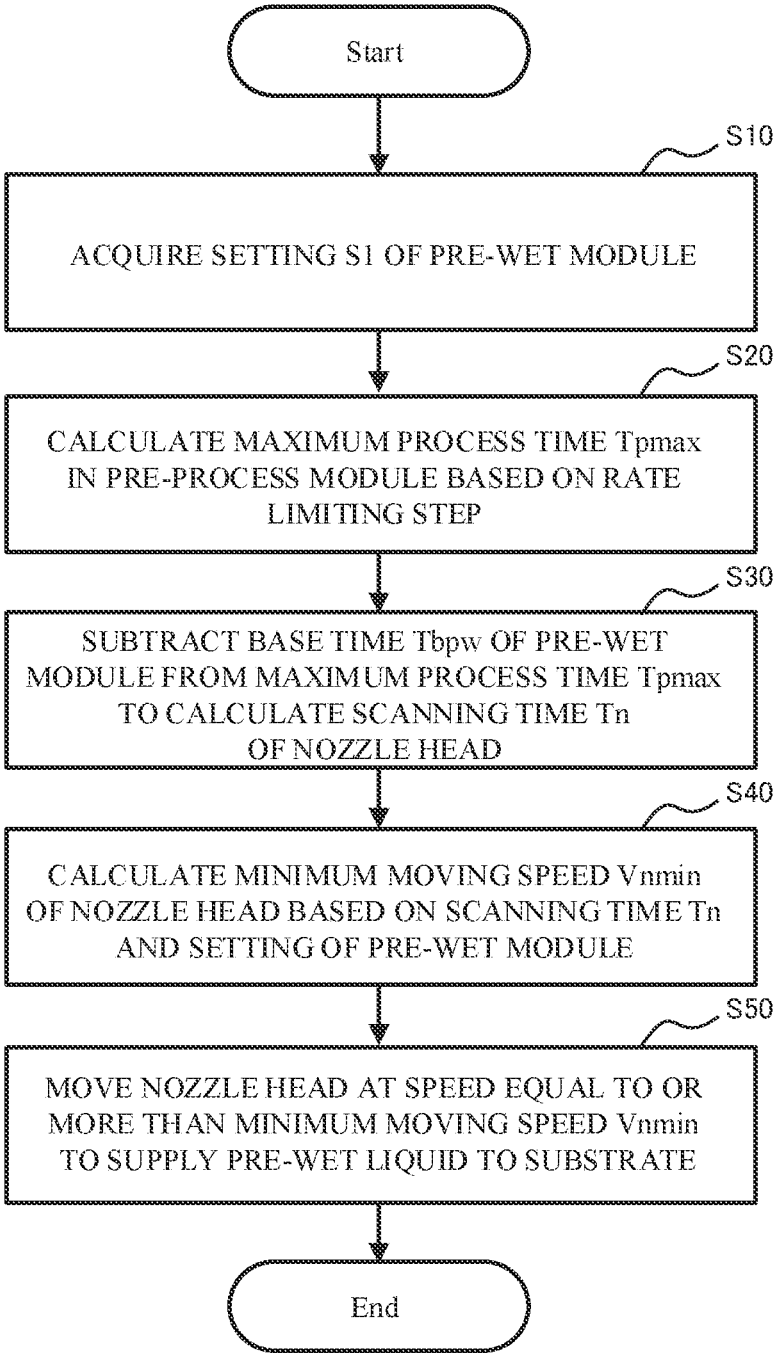
FIG. 8 is a flowchart illustrating an example of a pre-wet method by the plating apparatus.

FIG. 8 is a flowchart illustrating an example of a pre-wet method by the plating apparatus. This pre-wet method is executed by the control module 800. First, the control module 800 acquires setting S1 of the pre-wet module 200 (step S10). Here, as an example, the control module 800 can acquire the setting S1 of the pre-wet module 200 by reading settings stored in a memory the module itself has. As another example, the control module 800 may acquire the setting S1 of the pre-wet module 200 through communication or an external input via an operation panel (not illustrated). The setting S1 of the pre-wet module 200 is a predetermined or user-set pre-wet process recipe and may include, as an example, the number of times the nozzle head 260 scans on the substrate Wf (number Ns of scanning times). Further, the setting S1 may include a scanning distance Ls in one scanning time of the nozzle head 260.

Subsequently, the control module 800 calculates a maximum process time Tpmax in the pre-wet module 200 based on a rate limiting step of limiting a rate of a process in the whole plating apparatus 1000 (step S20). Here, the rate limiting step of limiting the rate of the process in the whole plating apparatus 1000 may be detected by the control module 800 at a predetermined timing (for example, every predetermined time or when a new substrate Wf is installed). Alternatively, the step may be known in advance by simulation or the like based on the recipe of the w % bole plating apparatus 1000. As an example, in the plating apparatus 1000, the plating module 400 can be a module that limits the rate of the whole apparatus (hereinafter also referred to as "the rate limiting module"). However, the present invention is not limited to these examples, and another module may be the rate limiting module. In the present embodiment, the pre-wet process by the pre-wet module 200 can be executed in parallel with the rate limiting step. As an example, the pre-wet module 200 is installed at a position different from a position of the rate limiting module in the plating apparatus 1000.

In the present embodiment, the rate limiting step is determined by calculating a throughput relevant value TH related to the throughput of each step in the plating apparatus 1000. As an example, a process time Ta (seconds) of a certain module M1 in the plating apparatus 1000 and a transfer time Tb (seconds) of the substrate Wf related to the module M1 may be acquired by actual measurement or simulation, and the throughput relevant value TH per hour of the module M1 can be calculated by the following equation (1). Here, in Equation (1), "Nm" indicates the number of modules M1 included in the plating apparatus 1000, and Nm steps by the modules M1 can be executed in parallel. In Equation (1), as an example, a unit of each of the process time Ta and the transfer time Tb is seconds, and the throughput per hour (3600 seconds) is calculated, but the present invention is not limited to this example.

$$TH = 3600/((Ta + Tb)/Nm) \quad (1)$$

Thus, by calculating the throughput relevant value TH of each step in the plating apparatus 1000, the module that limits the rate in the whole plating apparatus 1000 can be determined. That is, the module with the calculated throughput relevant value being smallest is the rate limiting module that limits the rate in the whole plating apparatus 1000, and the step executed by the rate limiting module can be considered to be a rate limiting step.

In the present embodiment, the maximum process time Tpmax of the pre-wet module 200 is calculated so that the pre-wet process by the pre-wet module 200 does not constitute the rate limiting step, that is, the pre-wet process is executed at a speed equal to or more than a speed of the known rate limiting step. As a specific example, the maximum process time Tpmax (seconds) can be calculated by the following equation (2). Here, in Equation (2), "THd" means the throughput relevant value TH by the rate limiting step, and "Npw" means the number of pre-wet modules 200 in the plating apparatus 1000 (two in the present embodiment), that is, the number of pre-wet modules that can execute the pre-wet processes in parallel. In Equation (2), as an example, the time in units of "seconds" is calculated as the maximum process time Tpmax but is not limited to this example.

$$Tp\max = (3600/THd) \times Npw \quad (2)$$

On calculating the maximum process time Tpmax in this manner, the control module 800 subtracts a base time Tbpw of the pre-wet module 200, to calculate a scanning time Tn of the nozzle head 260 (step S30). Here, the base time Tbpw corresponds to a miscellaneous time excluding the scanning time of the nozzle head 260 in the pre-wet module 200. For example, the base time Tbpw includes the transfer time of the substrate Wf concerning the pre-wet module 200. As the base time Tbpw, a time predetermined by simulation, actual measurement or the like can be used. Further, the base time Tbpw may be set in advance and included in the setting S1 of the pre-wet module 200 described above.

Subsequently, the control module 800 calculates a minimum moving speed Vnmin of the nozzle head 260 based on the scanning time Tn and the setting S1 of the pre-wet module 200 (step S40). In the present embodiment, the number Ns of scanning times is determined in advance, and as illustrated in the following equation (3), a product of the number Ns of scanning times and the scanning distance Ls is divided by the scanning time Tn, to calculate the minimum moving speed Vnmin of the nozzle head 260. However, the present invention is not limited to this example. For example, the control module 800 may display the minimum moving speed Vnmin for each scanning time Ns on a display (not illustrated). As an example, it may be displayed that "when the number of scanning times is 1, the minimum moving speed=x1 [mm/s], when the number of scanning times is 2, the minimum moving speed=x2 [mm/s], and when the number of scanning times is 3, the minimum moving speed=x3 [mm/s]". In this case, a user seeing the display may be able to select the number Ns of scanning times of the nozzle head 260.

$$Vn\min = (Ns \cdot Ls) / Tn \quad (3)$$

Then, the control module 800 moves (scans) the nozzle head 260 at a speed equal to or more than the calculated minimum moving speed Vnmin to supply the pre-wet liquid to the substrate Wf (step S50). For example, the control module 800 compares a predetermined recommended speed Vb and the minimum moving speed Vnmin, and when the recommended speed Vb is equal to or more than the minimum moving speed Vnmin, the nozzle head 260 may be moved at the recommended speed Vb. Further, when the recommended speed Vb is less than the minimum moving speed Vnmin, the control module 800 may move the nozzle head 260 at the minimum moving speed Vnmin. Further, the control module 800 is not limited to this example and may move the nozzle head 260 at the minimum moving speed Vnmin regardless of the value of the minimum moving speed Vnmin. Furthermore, a plurality of recommended speeds Vb1, Vb2 and Vb3 may be determined in advance, and the control module 800 may move the nozzle head 260 at the slowest recommended speed that is a speed equal to or more than the minimum moving speed Vnmin. Under such control, the pre-wet process can be effectively performed on the substrate Wf without any pre-wet process limiting the rate of the process in the whole plating apparatus 1000, that is, without affecting the throughput of the plating apparatus 1000.

The control module 800 may change the pre-wet process conditions while moving the nozzle head 260 during the pre-wet process. For example, the control module 800 may change the injection direction (injection center direction) of the pre-wet liquid during the pre-wet process. In this case, the nozzle head 260 may be driven so that at a first scanning time (for example, first scanning), a spray angle θn (see FIG. 6) of the pre-wet liquid is a first angle (for example, 90 degrees), and at a second scanning time (for example, second scanning), the spray angle θn of the pre-wet liquid is a second angle (for example, 60 degrees). Further, the control module 800 may change a distance between the substrate Wf and the nozzle head 260 during the pre-wet process. Further, the control module 800 may change a supply amount of the pre-wet liquid supplied from the nozzle head 260 or a component of the pre-wet liquid during the pre-wet process. In these cases, the control module 800 may change at least one selected from the distance between the substrate Wf and the nozzle head 260, the supply amount of the pre-wet liquid, and the component of the pre-wet liquid, for the first scanning time and the second scanning time. According to such processing, the pre-wet process can be performed on the substrate Wf on a plurality of conditions, and the pre-wet process can be performed more effectively. Such changes in pre-wet process conditions may be predetermined or set by the user and included in the setting S1 of the pre-wet module 200 described above.

Modification

Figure 9:
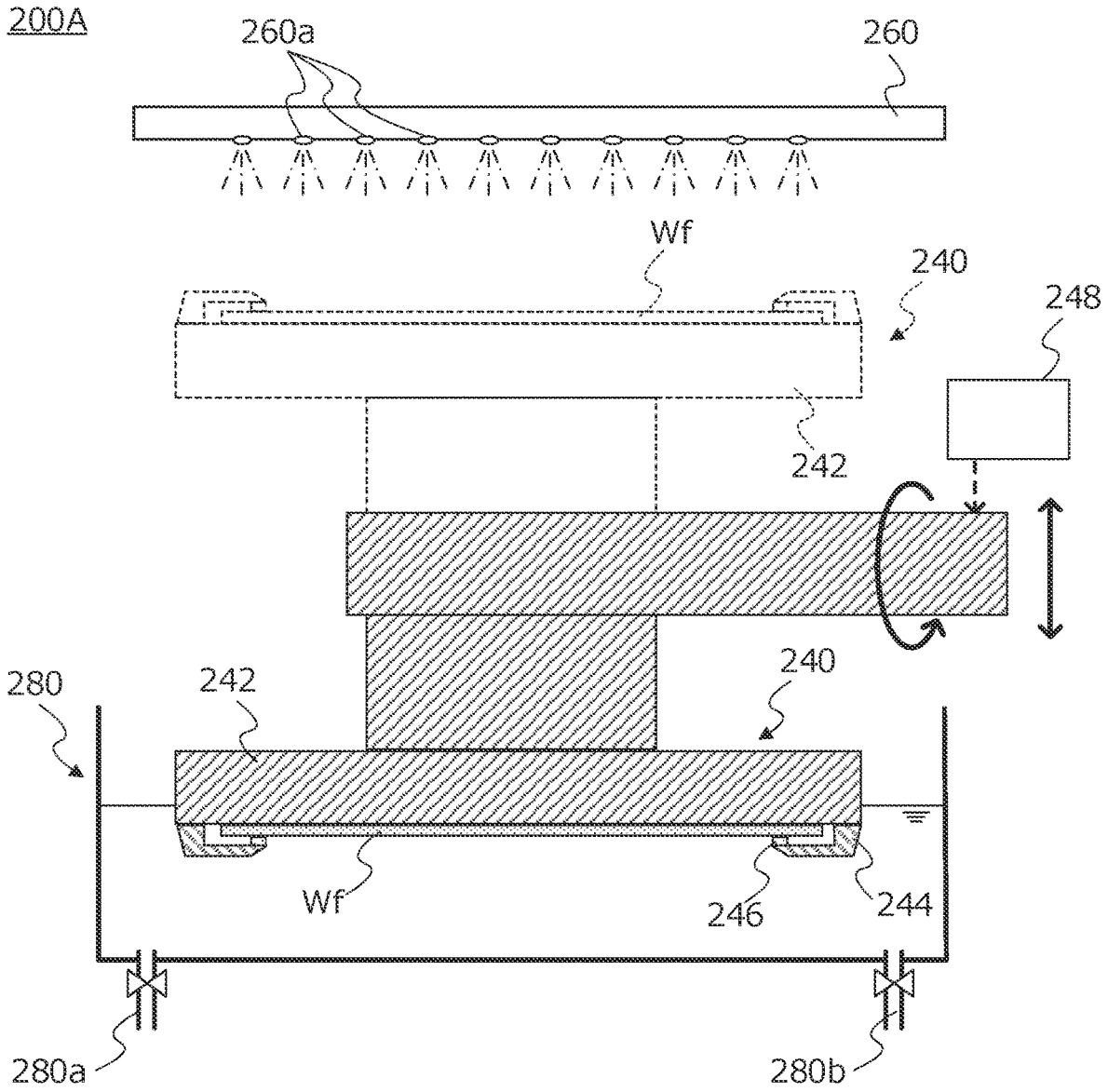
FIG. 9 is a view schematically illustrating a configuration of a pre-wet module according to a modification.

FIG. 9 is a view schematically illustrating a configuration of a pre-wet module of a modification. A pre-wet module 200A of the modification is about the same as the pre-wet module 200 of the above-described embodiment, and the same configuration is denoted with the same reference signs and is not described in duplicate. The pre-wet module 200A of the modification includes a pre-wet tank 280 in addition to a nozzle head 260. The pre-wet tank 280 includes a process liquid supply line 280*a* for supplying a process liquid (pre-wet liquid) into the pre-wet tank 280, and a process liquid discharge line 280*b* for discharging the process liquid from the pre-wet tank 280. In the pre-wet tank 280, the same process liquid as the pre-wet liquid supplied from the nozzle head 260 may be accumulated, or a different process liquid may be accumulated. Further, the pre-wet module 200A of the modification includes a drive mechanism 248 configured to switch a state of a pre-wetting stage 240 to a state where a substrate Wf is oriented upward and a state where the substrate is oriented downward. The drive mechanism 248 can be achieved by a known mechanism such as a motor. The drive mechanism 248 switches to the state where the substrate Wf (surface to be plated Wf-a) is oriented upward and supplies the pre-wet liquid from the nozzle head 260, so that a pre-wet process can be performed in the same manner as described above. The drive mechanism 248 is also configured to be able to move the pre-wetting stage 240 (substrate Wf) in an up-down direction in a state where the substrate Wf (surface to be plated Wf-a) is oriented downward. The pre-wetting stage 240 holding the substrate Wf is immersed in a process liquid accumulated in the pre-wet tank 280, thereby allowing the process liquid to act on the surface to be plated Wf-a of the substrate Wf. Alternatively, the pre-wet module 200A may move the pre-wetting stage 240 into the pre-wet tank 280 and then supply the process liquid from the process liquid supply line 280*a*, thereby allowing the pre-wet liquid to act on the substrate Wf. Alternatively, in a state where the process liquid is accumulated in the pre-wet tank 280, the pre-wet module 200A may move the pre-wetting stage 240 into the pre-wet tank 280, in which the process liquid acts on the substrate Wf.

Also in the pre-wet module 200A of this modification, the pre-wet liquid can be supplied from the nozzle head 260 to perform the pre-wet process in the same manner as in the pre-wet module 200 of the above embodiment. Further, the process liquid accumulated in the pre-wet tank 280 acts on the substrate Wf, while the pre-wet process can be performed. Also, in the pre-wet module 200A of the modification, the base time Tbpw described above (see step S30 in FIG. 8) may include a time for immersing the substrate Wf in the process liquid in the pre-wet tank 280. The time for immersing the substrate Wf in the process liquid in the pre-wet tank 280 may be included in setting S1 of the pre-wet module 200A.

The present invention can be described in the following aspects.

[Aspect 1] According to Aspect 1, a pre-wet process method for performing a pre-wet process before performing a plating process on a substrate in a plating apparatus is provided. The plating apparatus includes a plating module for performing the plating process on the substrate, and a pre-wet module for performing the pre-wet process on the substrate. The pre-wet module includes a nozzle head configured to be able to supply a pre-wet liquid to a plate surface of the substrate with movement along the plate surface of the substrate. Then, the pre-wet process method includes a step of calculating a maximum process time in the pre-wet module based on a rate limiting step of limiting a rate of a process in the w % bole plating apparatus, a step of calculating a minimum moving speed of the nozzle head based on the calculated maximum process time, and a step of moving the nozzle head at a speed equal to or more than the calculated minimum moving speed to supply the pre-wet liquid to the plate surface of the substrate. According to Aspect 1, the pre-wet process can be effectively performed in the substrate without affecting throughput.

[Aspect 2] According to Aspect 2, in Aspect 1, the step of calculating the minimum moving speed includes calculating the minimum moving speed based on the maximum process time and the number of times the nozzle head scans the plate surface. According to Aspect 2, the minimum moving speed of the nozzle head can be calculated based on the number of scanning times of the nozzle head.

[Aspect 3] According to Aspect 3, in Aspect 1 or 2, the plating apparatus includes a predetermined number of rate limiting modules that perform the rate limiting step, and the step of calculating the maximum process time includes dividing, by the predetermined number, a sum of a process time by the rate limiting module and a transfer time concerning the rate limiting module to calculate a throughput relevant value of the plating apparatus. According to Aspect 3, the maximum process time of the pre-wet module can be calculated based on the throughput relevant value.

[Aspect 4] According to Aspect 4, in Aspects 1 to 3, in the step of supplying the pre-wet liquid, the nozzle head scans the plate surface a predetermined number of times, at a first scanning time, a spray angle of the pre-wet liquid to the plate surface by the nozzle head is a first angle, and at a second scanning time, the spray angle is a second angle different from the first angle. According to Aspect 4, the pre-wet liquid can be sprayed to the plate surface of the substrate at different angles for each scanning.

[Aspect 5] According to Aspect 5, in Aspects 1 to 4, in the step of supplying the pre-wet liquid, the nozzle head scans the plate surface a predetermined number of times, and between a first scanning time and a second scanning time, a supply amount of the pre-wet liquid from the nozzle head or a component of the pre-wet liquid is different. According to Aspect 5, different supply amounts of the pre-wet liquid or the pre-wet liquid containing different components, for each scanning, can be sprayed to the plate surface of the substrate.

[Aspect 6] According to Aspect 6, in Aspects 1 to 5, the step of calculating the minimum moving speed includes subtracting, from the maximum process time, a base time including a transfer time of the substrate concerning the pre-wet module to calculate a scanning time of the nozzle head. According to Aspect 6, the scanning time of the nozzle head can be calculated based on the base time of the pre-wet module.

[Aspect 7] According to Aspect 7, in Aspect 6, the pre-wet module includes a pre-wet tank for housing the substrate to immerse the substrate in a process liquid, and the base time includes a time for immersing the substrate in the process liquid in the pre-wet tank. According to Aspect 7, the substrate can be immersed in the process liquid in the pre-wet tank. Further, the scanning time of the nozzle head can be calculated in consideration of the time for immersing the substrate in the process liquid.

[Aspect 8] According to Aspect 8, in Aspects 1 to 7, the rate limiting step is a step performed in the plating module.

[Aspect 9] According to Aspect 9, in Aspects 1 to 8, the plating module is provided at a first position, and the pre-wet module is provided at a second position different from the first position.

[Aspect 10] According to Aspect 10, in Aspects 1 to 9, the step of supplying the pre-wet liquid is performed in a state where a surface to be plated of the substrate is oriented upward.

The embodiments of the present invention have been described above, and the above embodiments of the present invention are described to facilitate understanding of the present invention and are not intended to limit the present invention. Needless to say, the present invention may be changed or modified without departing from the spirit, and the present invention includes equivalents to the invention. Also, in a range in which at least some of the above-described problems can be solved or a range in which at least some of effects are exhibited, any arbitrary combination of the embodiment and the modification is possible, and arbitrary combination or omission of respective constituent components described in claims and description is possible.

REFERENCE SIGNS LIST

200 pre-wet module
236 drive mechanism
238 pre-wet liquid supply source
240 pre-wetting stage
242 first holding member
244 second holding member
246 sealing body
248 drive mechanism
260 nozzle head
280 pre-wet tank
300 pre-soak module
400 plating module
800 control module
1000 apparatus

The invention claimed is:

1. A pre-wet process method for performing a pre-wet process before performing a plating process on a substrate in a plating apparatus, the plating apparatus comprising a plating module for performing the plating process on the substrate, and a pre-wet module for performing the pre-wet process on the substrate, the pre-wet module including a nozzle head configured to be able to supply a pre-wet liquid to a plate surface of the substrate with movement along the plate surface of the substrate, and a computer configured to perform the pre-wet process method comprising:

retrieving a recipe related to a plurality of processes associated with plating the substrate;

calculating by the computer, based at least in part on the recipe, a maximum process time in the pre-wet module based on a rate limiting step of limiting a rate of a first process among the plurality of processes associated with plating the substrate;

calculating by the computer a minimum moving speed of the nozzle head based on the calculated maximum process time;

instructing the plating apparatus by the computer to transfer the substrate to the pre-wet module;

instructing the nozzle head by the computer to move at a predetermined slowest recommended speed equal to or more than the calculated minimum moving speed to supply the pre-wet liquid to the plate surface of the substrate; and instructing the plating apparatus by the computer to transfer the substrate to the plating module for plating at the completion of supplying the pre-wet liquid.

2. The pre-wet process method according to claim 1, wherein calculating the minimum moving speed includes calculating the minimum moving speed based on the maximum process time and the number of times the nozzle head scans the plate surface.

3. The pre-wet process method according to claim 1, wherein the plating apparatus comprises a predetermined number of rate limiting modules that perform the rate limiting step, and calculating the maximum process time includes dividing, by the predetermined number, a sum of a process time by the rate limiting module and a transfer time concerning the rate limiting module to calculate a throughput relevant value of the plating apparatus.

4. The pre-wet process method according to claim 1, wherein in supplying the pre-wet liquid, the nozzle head scans the plate surface a predetermined number of times, at a first scanning time, a spray angle of the pre-wet liquid to the plate surface by the nozzle head is a first angle, and at a second scanning time, the spray angle is a second angle different from the first angle.

5. The pre-wet process method according to claim 1, wherein in supplying the pre-wet liquid, the nozzle head scans the plate surface a predetermined number of times, and between a first scanning time and a second scanning time, a supply amount of the pre-wet liquid from the nozzle head or a component of the pre-wet liquid is different.

6. The pre-wet process method according to claim 1, wherein calculating the minimum moving speed includes subtracting, from the maximum process time, a base time including a transfer time of the substrate concerning the pre-wet module to calculate a scanning time of the nozzle head.

7. The pre-wet process method according to claim 6, wherein the pre-wet module includes a pre-wet tank for housing the substrate to immerse the substrate in a process liquid, and the base time includes a time for immersing the substrate in the process liquid in the pre-wet tank.

8. The pre-wet process method according to claim 1, wherein the rate limiting step is a step performed in the plating module.

9. The pre-wet process method according to claim 1, wherein the plating module is provided at a first position, and the pre-wet module is provided at a second position different from the first position.

10. The pre-wet process method according to claim 1, wherein supplying the pre-wet liquid is performed in a state where a surface to be plated of the substrate is oriented upward.

* * * * *